United States Patent [19]

Dibowski

[11] Patent Number: 4,978,122

[45] Date of Patent: Dec. 18, 1990

[54] BARBELL

[76] Inventor: Christian Dibowski, Kehlenweg 4, 7801 Pfaffenweiler, Fed. Rep. of Germany

[21] Appl. No.: 443,067

[22] Filed: Nov. 28, 1989

Related U.S. Application Data

[63] Continuation of Ser. No. 287,913, Dec. 21, 1988, abandoned.

[30] Foreign Application Priority Data

Jan. 5, 1988 [DE] Fed. Rep. of Germany ..... 8800050

[51] Int. Cl.[5] ..... A63B 21/72

[52] U.S. Cl. ..... 272/123; 272/130; 272/141; 272/142

[58] Field of Search ..... 272/67, 68, 93, 116, 272/117, 122, 123, 124, 130, 135, 137, 141, 142, 143

[56] References Cited

U.S. PATENT DOCUMENTS

| | | | |
|---|---|---|---|
| 1,119,169 | 12/1914 | Kepple | 272/122 |
| 1,308,259 | 7/1919 | Sandow | 272/68 |
| 3,638,941 | 2/1972 | Kulkens | 272/142 X |
| 3,726,522 | 4/1973 | Silberman | 272/123 |
| 3,756,597 | 9/1973 | Monti | 272/123 |
| 3,761,083 | 9/1923 | Buchner | 272/137 |
| 4,021,040 | 5/1977 | Inoue | 272/123 |
| 4,623,146 | 11/1986 | Jackson | 272/123 X |
| 4,627,618 | 12/1986 | Schwartz | 272/122 |
| 4,695,049 | 9/1987 | Ciemiega | 272/67 |
| 4,768,780 | 9/1988 | Hayes | 272/143 X |
| 4,787,629 | 11/1988 | DeMyer | 272/123 |
| 4,832,334 | 5/1989 | Mullen | 272/123 |

OTHER PUBLICATIONS

Berg Sports Equipment Brochure.

*Primary Examiner*—Robert W. Bahr

*Attorney, Agent, or Firm*—Jeffers, Hoffman & Niewyk

[57] ABSTRACT

A barbell including a spring handle mounted on the bar of said barbell whereby the user may force the handle outwardly against the urging of said spring. The barbell includes a bar, one or more weighted discs mounted on the bar and a safety lock for preventing the discs from sliding off the bar. A locking ring is secured to the bar adjacent the discs. One end of a spring is secured to the locking ring. The other end of the spring is secured to a handle. The handle is axially moveable against the urging of the spring for compressing the spring. A detent is also provided on the bar to define an end position of the handle.

7 Claims, 1 Drawing Sheet

BARBELL

This is a continuation of application Ser. No. 287,913, filed Dec. 21, 1988, now abandoned.

BACKGROUND OF THE INVENTION

This invention pertains to a barbell including a device for exercising the upper body muscles, particularly the chest muscles. More specifically, the invention pertains to a barbell having a spring loaded handle including a detent for mounting on the barbell.

Prior art barbell designs have not included spring loaded handles. These barbells consist of a simple steel or iron bar which is provided with weighting disks and which is used for developing chest muscles or other muscle groups.

With such prior art barbells, the user was limited to lifting and lowering the device i.e. exercising with primarily dynamic. The intent of such dynamic strength training is to achieve a training effect, either through the use of a large weight or through the use of a high number of competitive movements.

A problem with such dynamic training with prior art barbells has been the potential of over loading and stressing of tendons and ligaments and the relatively high training expense.

It is an object of the present invention to eliminate the above mentioned disadvantages of prior art barbells.

SUMMARY OF THE INVENTION

The present invention overcomes the above identified disadvantages by the use of a spring mounted handle mounted on the bar of the barbell. The spring loaded handle consists of a locking ring, a spring in contact therewith and a handle together with a detent or stop.

An advantage of the present invention is that it permits the user to exercise the upper body muscles by working the handle against the resilence of the spring while lifting the barbell. The barbell, according to the present invention, enables a static-dynamic, combined exercising of the upper body muscles, particularly the chest muscles. The lifting work required for lifting and lower the barbell is complemented by holding work for holding the handles against the biasing force of the springs. This permits a reduction of the weight of the weighting disks of the barbell and thus protects the muscles, tendons and ligaments used in exercising with the barbell for overloading. Further, the effect of the exercise is also improved by the additional isometric contraction of the muscle groups which participate in the exercise. It is also possible to exchange the spring for different size springs having a greater or lesser spring biasing force or to vary the spacing of the detent from the handle as required by various individuals.

BRIEF DESCRIPTION OF THE DRAWINGS

The above mentioned and other features and objects of this invention and the manner of attaining them will become more apparent and the invention itself will be better understood by reference to the following description of an embodiment of the invention taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
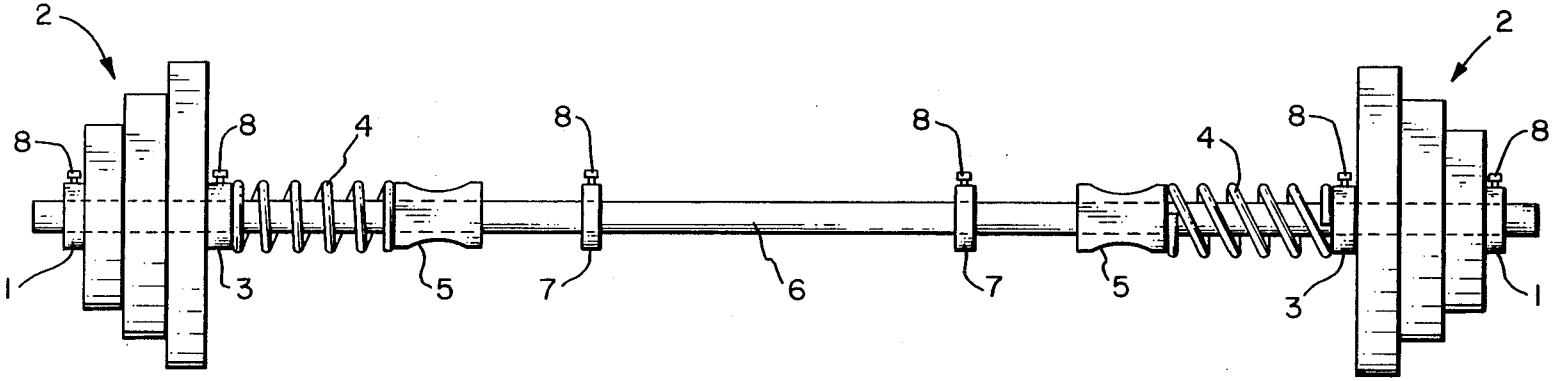
FIG. 1 is an elevational view of the barbell according to the present invention.
Figure 2:
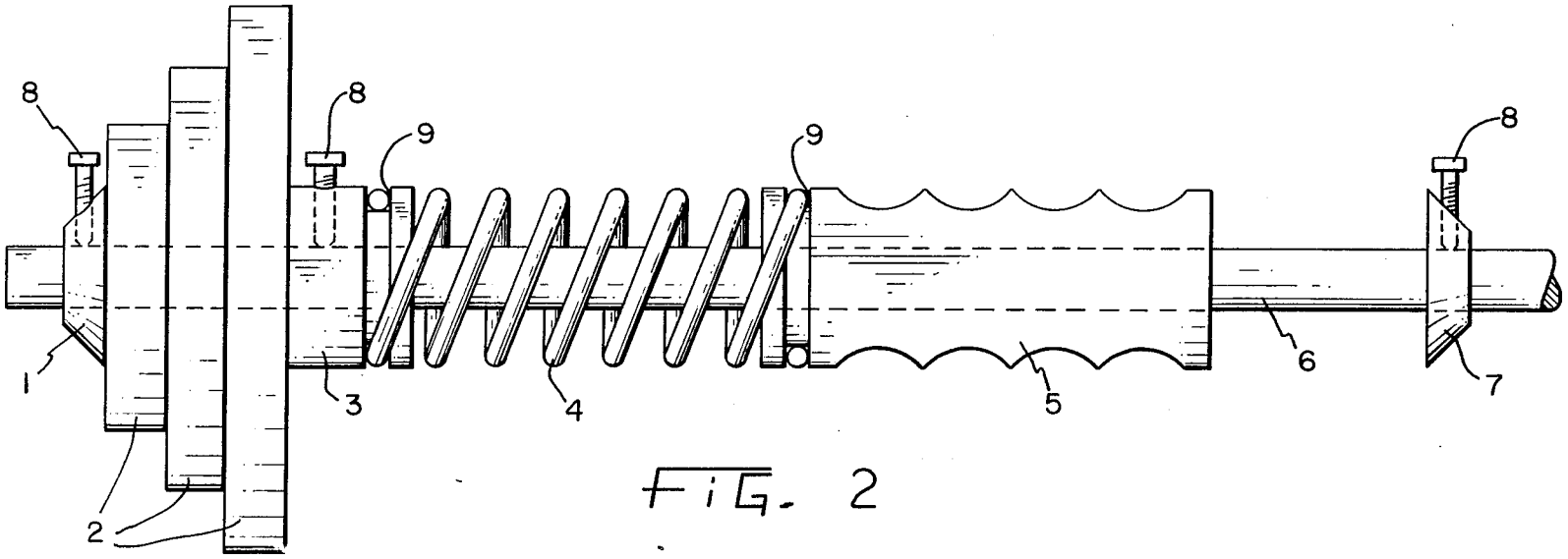
FIG. 2 is an enlarged elevational view of the left hand portion of the barbell of FIG. 1.

Referring to FIG. 1 and 2 there is shown a barbell including a bar 6, weighting disks 2 mounted on either side of bar 6, and a pair of safety locks 1 mounted on both the left hand and right hand side of the bar to prevent the weights from slipping off the bar. Safety locks 1 include locking screws 8 to secure the locks to the bar. Locking rings 3 are provided on the inward side of disks 2 to prevent the disk from moving about on the bar. Locking rings 3 are secured to the bar by screws 8, similarly to safety locks 1. A pair of springs 4 are secured to locking rings 3 in any suitable manner and handles 5 are secured to the other ends of springs 4. In the disclosed embodiment, the springs are secured to locking rings 3 and handles 5 by locking grooves 9. However, any suitable method such as soldering, welding, adhesive or the like may be employed. A pair of detents 7 are provided which are secured to the bar by means of locking screws 8. Detents 7 enables the user to observe a constant spacing from the weighting disks 2 during the lifting and lowering of the barbell.

In operation, handle 5 may be pulled inwardly until it comes to rest against detent 7 and may be forced outwardly against the force of spring 4. Thus spring 4 acts as both a compression and expansion spring to permit the user to exercise the upper body muscles against the force of spring 4.

Thus the invention enables a static-dynamic, combined exercising of the upper body muscles, particularly the chest muscles. The lifting work required for lifting and lowering the barbell is thus complimented by the holding work for pulling or pushing the handles 5 against the tension of springs 4. This arrangement permits reduction of the weight of disks 2, thus sparing the muscles, tendons, and ligaments from over loading and stress during exercising. The effect of the exercise is also increased by the additional isometric contraction of the muscle groups which participate in the exercise.

It is also possible to change the spring handle 3, 4, and 5 with a spring handle providing greater or lesser spring force or to vary the spacing of detents 7 from handles 5 according to individual need.

It should also be noted that instead of mechanical spring 4, a pneumatic resilient device could be provided, operating on air pressure, to provide pulling and pushing resistance for handles 5.

The invention may also be used in connection with specially designed machines, for instance, chest and shoulder exercising machines.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A barbell including a bar, one or more weighted disks mounted on said bar, a safety lock means for preventing said disks from sliding off said bar, a locking ring means secured to said bar adjacent said discs, resilient means having a first end secured to said locking ring means, a handle adapted to contact a second end of said resilient means and being axially movable on said bar to compress or extend said resilient means, and a detent adapted to be secured to said bar for defining an end position for said handle.

2. The barbell according to claim 1 wherein said locking ring means, resilient means, and handle form an integral unit.

3. The barbell according to claim 1 wherein said handle is made from plastic material.

4. The barbell according to claim 1 wherein said resilient means is a spring.

5. A barbell including a bar, one or more weighted disks mounted at either end of said bar, a pair of locks mounted respectively on opposite ends of said bar for preventing said weighted disks from sliding off said bar, a pair of locking rings mounted adjacent said weighted disks at either end of said bar to prevent said disks from moving axially inwardly on said bar, a pair of springs respectively having one end thereof secured to said locking rings and a pair of handles secured to the other ends of said springs, said handles being axially positioned on said bar by said springs, said handles being axially moveable on said bar to compress or extend said springs, and a pair of detents mounted on said bar, axially inwardly of said handles to define a range of travel of said handles on said bar.

6. The barbell according to claim 5 wherein said handle is made of plastic material.

7. The barbell according to claim 5 wherein said resilient means is pneumatic.

* * * * *